United States Patent [19]

Shepley et al.

[11] 4,348,244

[45] Sep. 7, 1982

[54] LUBRICATING COMPOSITIONS FOR PRIMARY BACKING FABRICS USED IN THE MANUFACTURE OF TUFTED TEXTILE ARTICLES

[75] Inventors: John D. Shepley; Herman M. Muijs, both of Amsterdam, Netherlands

[73] Assignee: Shell Oil Company, Houston, Tex.

[21] Appl. No.: 260,139

[22] Filed: May 4, 1981

Related U.S. Application Data

[62] Division of Ser. No. 48,289, Jun. 13, 1979, Pat. No. 4,288,331.

[30] Foreign Application Priority Data

Oct. 20, 1978 [GB] United Kingdom ..... 41466/78

[51] Int. Cl.[3] ..... D06M 13/18; B32B 5/00

[52] U.S. Cl. ..... 156/72; 8/115.6; 252/8.9; 428/96

[58] Field of Search ..... 156/72; 428/96; 252/8.9; 8/115.6

[56] References Cited

U.S. PATENT DOCUMENTS

| | | | |
|---|---|---|---|
| 3,370,056 | 2/1968 | Yotsuzuka et al. | 568/606 |
| 3,919,097 | 11/1975 | Park | 252/48.6 |
| 4,134,841 | 1/1979 | Park et al. | 252/48.6 |

FOREIGN PATENT DOCUMENTS

| | | | |
|---|---|---|---|
| 1347915 | 2/1974 | United Kingdom | 252/52 A |
| 1482963 | 9/1975 | United Kingdom | 252/52 A |

*Primary Examiner*—James J. Bell

[57] ABSTRACT

A novel lubricating composition useful in the manufacture of tufted textile articles comprises a polyalkoxylate lubricating oil and a minor amount of a long chain fatty acid.

4 Claims, No Drawings

LUBRICATING COMPOSITIONS FOR PRIMARY BACKING FABRICS USED IN THE MANUFACTURE OF TUFTED TEXTILE ARTICLES

This is a division, of application Ser. No. 048,289, filed June 13, 1979 now U.S. Pat. No. 4,288,331.

BACKGROUND OF THE INVENTION

This invention is concerned with a novel lubricating composition useful in the manufacture of tufted textile articles. More particularly, this invention relates to a lubricating composition comprising a polyalkoxylate lubricating oil and a minor amount of a long chain fatty acid, which may be used to coat the primary backing fabric during the manufacture of tufted textile articles such as carpeting.

It is known to manufacture tufted textile articles by inserting yarn into a primary backing fabric by means of needles. Very simply, the yarn in threaded through holes in the ends of needles which are then pushed through the moving primary backing fabric. As the needles reach their lowest positions, the yarn is hooked on to loopers to form loops under the primary backing fabric. The needles are then withdrawn and the action repeated during which the loopers are removed from the previously formed loops and form further loops. This process is known as tufting. Further information on the manufacture of tufted textile articles may be found in "Tufting: an introduction" by D. T. Ward, Textile Business Press Limited, 1969.

Various types of primary backing fabrics are used in the manufacture of tufted textile articles. These fabrics may be of the woven or non-woven type and may be made of natural, e.g. jute, or synthetic fibers such as polyolefinic material e.g. polypropylene. Particularly useful fabrics are woven polypropylene tapes. In order for the manufacture of the articles to be technically and economically sound, it is desirable that the primary backing fabric provide little resistance against the insertion and withdrawal of the needles and that damage to the backing fabric by action of the tufting needles by minimized so that the tufted textile articles themselves are strong. The use of lubricants on the primary backing fabric to improve the manufacture in one or more of the above respects is known, e.g. see Carpet and Rug Industry, August 1976, page 28; British Pat. No. 1,347,915 and U.S. Pat. No. 3,919,097.

Polyalkoxylate lubricating oils are disclosed as fiber processing aids for textile manufacturing in British Pat. No. 1,482,963. Similarly, polyoxyalkylene polymers are disclosed as textile auxiliaries in U.S. Pat. No. 3,370,056 and as fiber lubricants in U.S. Pat. No. 4,134,841.

SUMMARY OF THE INVENTION

A lubricating composition has now been found which is exceptional in reducing needle resistance and deflection in the tufting process and in minimizing needle damage to the primary backing fabric during tufted textile manufacture. Accordingly, the present invention provides a lubricating composition comprising a major amount of polyalkoxylate lubricating oil and a minor amount of a saturated or unsaturated aliphatic carboxylic acid of from 10 to 20 carbon atoms. In a further aspect of the present invention, said lubricating composition additionally contains a minor amount of one or more of an anti-oxidant, a corrosion inhibitor, water and a wetting agent. In yet another aspect of the present invention, the process for the manufacture of tufted textile articles, e.g. carpeting; by the insertion of yarn into a primary backing fabric by means of needles is improved by coating the primary backing fabric with said lubricating composition prior to needle insertion of yarn into the primary backing fabric.

DESCRIPTION OF THE PREFERRED EMBODIMENTS

The polyalkoxylate lubricating oils used in the present invention are well known and include polyoxyethylene glycols, polyoxypropylene glycols and random or block alkoxylated glycol and alkoxylated fatty acid copolymers, e.g. the reaction products of $C_{10}$ to $C_{20}$ saturated or unsaturated acids with ethylene oxide or polyoxyethylene glycol. The preferred polyalkoxylate lubricating oils are the polyalkoxylated, e.g. polyethoxy- and/or polypropoxylated, $C_3$ to $C_{20}$ alcohols. Such alcohols may be primary, secondary or tertiary alcohols and may be monols or polyols e.g. diols or triols. The number of alkoxy units present in such polyalkoxylate lubricating oils is suitably from 5 to 20 units per molecule. The most preferred polyalkoxylate lubricating oils are those described in British Pat. No. 1,482,963, namely one or more compounds of formula:

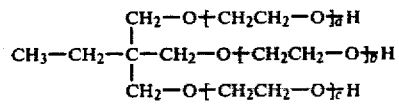

wherein a, b and c are zero or integers and the average total of a+b+c is from 5 to 18, preferably from 12 to 17. Suitably a mixture of compounds is used which is prepared by reacting trimethylolpropane with ethylene oxide in amounts such that each mole of product contains on average from 5 to 18 moles of ethylene oxide per mole of trimethylolpropane.

The fatty acid component of the lubricating composition is an unsaturated or saturated aliphatic carboxylic acid of from 10 to 20 carbon atoms, preferably from 14 to 18 carbon atoms. Preferred aliphatic carboxylic acids include lauric acid, myristic acid, palmitic acid, oleic acid, linoleic acid and linolenic acid, with oleic acid being more preferred. The polyalkoxylate lubricating oil is the major component of the lubricating composition, although the amount of fatty acid present in the lubricating composition may vary between wide limits. The amount of fatty acid present is preferably between 0.001% and 10%, based on the weight of the polyalkoxylate lubricating oil, with amounts from 0.01% to 5% being more preferred.

In addition to the polyalkoxylate lubricating oil and the fatty acid, the lubricating composition may optionally and preferably also contain one or more of an anti-oxidant, a corrosion inhibitor, water and a wetting agent. In this regard, preferred anti-oxidants include phenolic antioxidants such as di-tert-butyl-cresol, diphenylolpropane and alkylated diphenylolpropanes. Preferred corrosion inhibitors include mono- or polyalkyl phosphates, phosphites or phosphonates, sodium benzoate or lauroylsarcosine. The presence of water is especially preferred if clear solutions are desired. Preferred wetting agents include conventional non-ionic surfactants, for example, ethoxylated alkylphenols, glycerol esters or fatty diethanolamides. Suitable amounts of anti-oxidants are from 0.05% to 1%, suitable amounts of corrosion inhibitors are from 0.1% to 5%, suitable amounts of water are from 1.0% to 25%, and suitable amounts of wetting agents are from 1% to 5%, again all based on the weight of the polyalkoxylate lubricating oil.

The present invention is particularly useful for coating polyolefinic primary backing fabrics. The fabric may be of the non-woven type, e.g. spun-bonded polypropylene, but is preferably a woven fabric such as those prepared from polypropylene tape. Depending on the particular fabric used, it may be possible to apply the lubricating composition to the fibers thereof before or after they have been made-up into the primary backing fabric. However, the lubricating composition is preferably applied to the primary backing fabric itself. The lubricating composition may be applied to one or both sides of the fabric and the amount is preferably such to provide the fabric with from 0.5% to 10% by weight of lubricating composition, based on the weight of the fabric. Suitably, the lubricating composition is applied as a dilute aqueous solution, e.g. from 5% to 30% aqueous solution, and the water allowed to evaporate. The yarn is then inserted into the primary backing fabric by means of needles. The yarn which is used to manufacture the tufted textile articles by tufting the primary fabric backing may be of any type e.g. wool, cotton, rayon, nylon, acrylic or polyester yarns or mixtures thereof. The tufts maybe cut to produce cut pile tufting or may not be cut (loop pile tufting). The tufted textile articles may also be provided with a secondary backing material e.g. latex, nonwoven polypropylene or jute. The present invention is particularly useful for manufacturing tufted textile floor coverings e.g. carpets.

The invention will be further illustrated in the following examples, which are not to be construed as limiting its scope. Additional information on the test methods may be found in *Carpet and Rug Industry,* Nov. 1975 at page 12 and May 1976 at page 16.

EXAMPLES

The compositions used in the Examples are given in Table 1. The polyalkoxylate oil used was prepared by reacting liquid trimethylol propane (TMP) with 14.4 moles of ethylene oxide (EO) in the presence of a basic catalyst.

TABLE 1

| Lubricating Composition | Polyalkoxylate Oil | Oleic Acid % w[1] | Diphenylol Propane % w[1] | Sodium Benzoate % w[1] | Water % w[1] |
|---|---|---|---|---|---|
| A | TMP/EO adduct | 1.0 | 0.075 | 1.5 | 5.0 |
| B | TMP/EO adduct | 0.1 | 0.075 | 1.5 | 5.0 |
| C[2] | TMP/EO adduct | — | 0.075 | 1.5 | 5.0 |

[1] = base on weight of polyalkoxylate oil
[2] = comparative (not according to the invention).

The compositions were applied as 20% by weight aqueous solutions (1% by weight on fabric) to woven polypropylene tape primary backing fabrics which when dry were tufted with nylon 6 BCF yarn, a textured nylon-filament yarn, to produce tufted textile articles.

The force required for the needles (Singer Type 0631-TDE) to penetrate and to be withdrawn from the fabric during the tufting operation was measured and the deflection of the needles also determined. These results are present in Table 2 and are expressed as the percentage of the results obtained with the same backing fabric but which had not been treated with a lubricating composition.

TABLE 2

| | Lubricating Composition | | |
|---|---|---|---|
| | A | B | C |
| Force of Penetration | 36 ± 1 | 43 ± 1 | 43 ± 1 |
| Force of Withdrawal | 55 ± 1 | 58 ± 1 | 74 ± 1 |
| Deflection | 62 ± 3 | 82 ± 3 | 95 ± 5 |

In addition, the percentage decrease in strength of the backing fabrics (measured in the weft direction) caused by the damaging effect of the tufting needles was determined. The results are given in Table 3.

TABLE 3

| Composition | Strength loss (%) |
|---|---|
| —[3] | 45 ± 5 |
| A | 6 ± 10 |
| B | 15 ± 10 |
| C | 35 ± 4 |

[3] = no lubricant.

What is claimed is:

1. In the process for the manufacture of tufted textile articles by inserting yarn into a primary backing fabric by means of needles, the improvement which comprises coating said primary backing fabric with a lubricating composition prior to needle insertion of yarn into the primary backing fabric, where said lubricating composition comprising a major amount of a polyalkoxylate lubricating oil and 0.001 to 10% by weight, based on the polyalkoxylate lubricating oil, of a saturated or unsaturated aliphatic carboxylic acid of from 10 to 20 carbon atoms.

2. The process according to claim 1 wherein said polyalkoxylate lubricating oil is one or more of compounds of the formula:

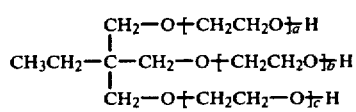

wherein a, b and c are zero or integers and the average total of a+b+c is from 5 to 18.

3. The process according to claim 2 wherein said saturated or unsaturated aliphatic carboxylic acid is oleic acid.

4. The process according to claim 3 wherein said lubricating composition additionally contains one or more of from 0.05 to 1% by weight of an antioxidant, from 0.1 to 5% by weight of a corrosion inhibitor, from 1.0 to 25% by weight of water and from 1% to 5% by weight of a wetting agent.

* * * * *